US005910076A

United States Patent [19]

Gladney

[11] Patent Number: 5,910,076

[45] Date of Patent: Jun. 8, 1999

[54] EXTENSIBLE WINDOW AND DOOR GUARD

[76] Inventor: Joe Louis Gladney, 2301 Sinclair La., Baltimore, Md. 21213

[21] Appl. No.: 08/914,050

[22] Filed: Jul. 15, 1997

[51] Int. Cl.[6] ..... E06B 3/68

[52] U.S. Cl. ..... 49/55; 49/67; 49/56

[58] Field of Search ..... 49/55, 56, 50, 49/61, 63, 67

[56] References Cited

U.S. PATENT DOCUMENTS

| | | | |
|---|---|---|---|
| 4,630,396 | 12/1986 | Zvi et al. | 49/55 |
| 4,937,975 | 7/1990 | Zilkha | 49/55 X |
| 5,056,262 | 10/1991 | Schweiss et al. | 49/55 X |
| 5,365,696 | 11/1994 | Ruiz | 49/56 X |
| 5,716,041 | 2/1998 | Groves | 49/55 X |

*Primary Examiner*—Jerry Redman
*Attorney, Agent, or Firm*—Law Offices of Royal W. Craig

[57] ABSTRACT

An improved security apparatus including a security grill having an extending left section and right section. The left section includes a left vertical support member, a plurality of tubular lateral support members extending rightwardly therefrom, and a plurality of vertical bars attached to and supported by the lateral support members. The right section comprises a right vertical support member, a plurality of tubular lateral support members extending leftwardly therefrom, and a plurality of vertical bars attached to and supported by the lateral support members. A plurality of intermediate extension members are each inserted into a corresponding pair of the left and right tubular lateral support members and are slidable therein to allow extension of said left security grill section with respect to the right section. The security apparatus includes a left angle bracket for securing one side of the security grill to a door or window frame, and a right angle bracket for securing another side of the security grill to an opposing side of said door or window frame. This way, the security apparatus may be attached exteriorly to a door or window frame to prevent forcible entry. In addition, the right grill section may be attached to the right angle bracket by a plurality of hinges to allow outward pivoting and to provide authorized access to the dwelling. Moreover, a number of hitch and mounting bracket combinations may be welded to the left angle bracket, and the left grill section may include a corresponding number of padlock enclosures welded to the face thereof, such that when the security grill is closed, the hitches protrude into padlock enclosures to allow locking with a conventional padlock. The padlock enclosure obscures access to the padlocks, thereby maximizing security.

4 Claims, 6 Drawing Sheets

EXTENSIBLE WINDOW AND DOOR GUARD

BACKGROUND OF THE INVENTION

1. Field of the invention

The present invention relates to window and door guards for protecting against forced access through existing windows and doors, and, more particularly, to an improved extensible window and door guard which adapts to various-sized openings, and which increases security by a impenetrable welded matrix of bars, inaccessible fasteners and extensors for attachment to various doors and window frames, and protective padlock enclosures.

2. Description of the Background

Many conventional barred security devices exists for protecting windows and doors. These generally comprise a structure of bars which is screwed into the door or window frame to prevent access. Some of these guards are provided with hinges to allow opening in a swinging fashion.

For example, U.S. Pat. No. 5,461,827 to Lofton discloses a telescoping window bar unit having an upper section that is permanently fixed to a window frame, and a lower section which has locking devices at the bottom and which is configured to telescopically slide into and out of the upper section, such that the unit blocks the entire window when closed, but allows access to the window when the lower section engages the upper section.

U.S. Pat. No. 5,446,996 to Lamont discloses a portable security grill for a window opening having vertically telescoping members having flat plates at their tops, with the flat plates being attached atop a toggle clamp allowing the vertical members to extend to the full height of the window opening.

U.S. Pat. No. 5,339,567 to Pierpont et al. discloses an interior-mounted security bar system for a window opening having side brackets which are permanently affixed to the window frame, vertical cross bar end members which slide vertically within channels in the side brackets, and horizontal telescoping rods running between the vertical cross bar end members such that the bar system may fit window openings of varied widths.

U.S. Pat. No. 5,283,976 to Lamont discloses another embodiment of the Lamont '996 patent, including a horizontal cross bar across the top of the grill for engaging the top portion of a window edge.

U.S. Pat. No. 5,018,302 to Kluge discloses a swinging bar assembly for a door or window opening having vertically and horizontally disposed bar members which are arranged such that the horizontal members are fixedly attached to certain of the vertical members, while slidably attached to other vertical members, thus allowing the bar assembly to be fitted to openings of varied widths.

U.S. Pat. No. 4,671,012 to Merklinger et al. discloses a security barrier for a door or window having horizontal and vertical bar members arranged such that the horizontal members are telescopic, allowing the barrier to be fitted to openings of varied widths.

U.S. Pat. No. 4,630,396 to Zvi et al. discloses a swinging security gate for a door or window having a provision for adding additional horizontal bar members as needed to increase the height of the gate to fit the proper opening height.

U.S. Pat. No. 4,624,072 to Zilkha discloses a swinging adjustable secuirty window gate having vertical telescoping bar members allowing the gate to be adjusted to openings of various height.

It is clear from the above that the general concept of a security gate having means to adjust the gate's size for various openings is known in the prior art. However, none of the above-described devices are well-suited for use by contractors in building or renovating dwellings. In this context, the door or window guard should be attached from the exterior of the dwelling. The design should be such that all of the anchors to the door/window frame are inaccessible from the outside. Moreover, the door guard should be hinged to allow easy authorized entry, yet should be padlocked in such a way that the padlock is inaccessible from the outside. All of the above-described designs must either be attached inside the dwelling, or they provide far to much access to the extending mechanism or anchors (to the door/window frame) and thereby compromise security.

Accordingly, it would be a great advantage to provide a door and window security grill which is better-suited for use by contractors in building or renovating dwellings, e.g., the door or window guard should be attachable from the exterior of the dwelling. Moreover, the door guard should be hinged to allow easy authorized entry, yet should be lockable by an enclosed padlock to prevent forcible entry from the outside. The device should provide absolutely no access to the extending mechanism or anchors (to the door/window frame), thereby maximizing security.

SUMMARY OF THE INVENTION

It is, therefore, an object of the present invention to provide a door and window security apparatus which is more easily moved from project to project, and is thereby better-suited for use by contractors in building or renovation.

It is another object to provide a door guard that is hinged to allow easy authorized entry, yet is lockable by an enclosed padlock to prevent forcible entry from the outside.

It is another object to obscure or prevent access to all anchors (to the door/window frame), thereby maximizing security.

According to the present invention, the above-described and other objects are accomplished by providing an improved security apparatus including a security grill having an extending left section and right section. The left section includes a left vertical support member, a plurality of tubular lateral support members extending rightwardly therefrom, and a plurality of vertical bars attached to and supported by the lateral support members. The right section comprises a right vertical support member, a plurality of tubular lateral support members extending leftwardly therefrom, and a plurality of vertical bars attached to and supported by the lateral support members. A plurality of intermediate extension members are each inserted into a corresponding pair of the left and right tubular lateral support members and are slidable therein to allow extension of said left security grill section with respect to the right section. The security apparatus also includes a left angle bracket for securing one side of said security grill to a door or window frame, and a right angle bracket for securing another side of said security grill to an opposing side of said door or window frame. The security apparatus may be attached exteriorly to a door or window frame to prevent forcible entry.

In addition, the right grill section may be attached to the right angle bracket by a plurality of hinges to allow outward pivoting and to provide authorized access to the dwelling. Moreover, a number of hitch and mounting bracket combinations may be welded to the left angle bracket, and the left grill section may include a corresponding number of padlock enclosures welded to the face thereof, such that when the security grill is closed, the hitches protrude into padlock enclosures to allow locking with a conventional padlock. The padlock enclosure obscures access to the padlocks, thereby maximizing security.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
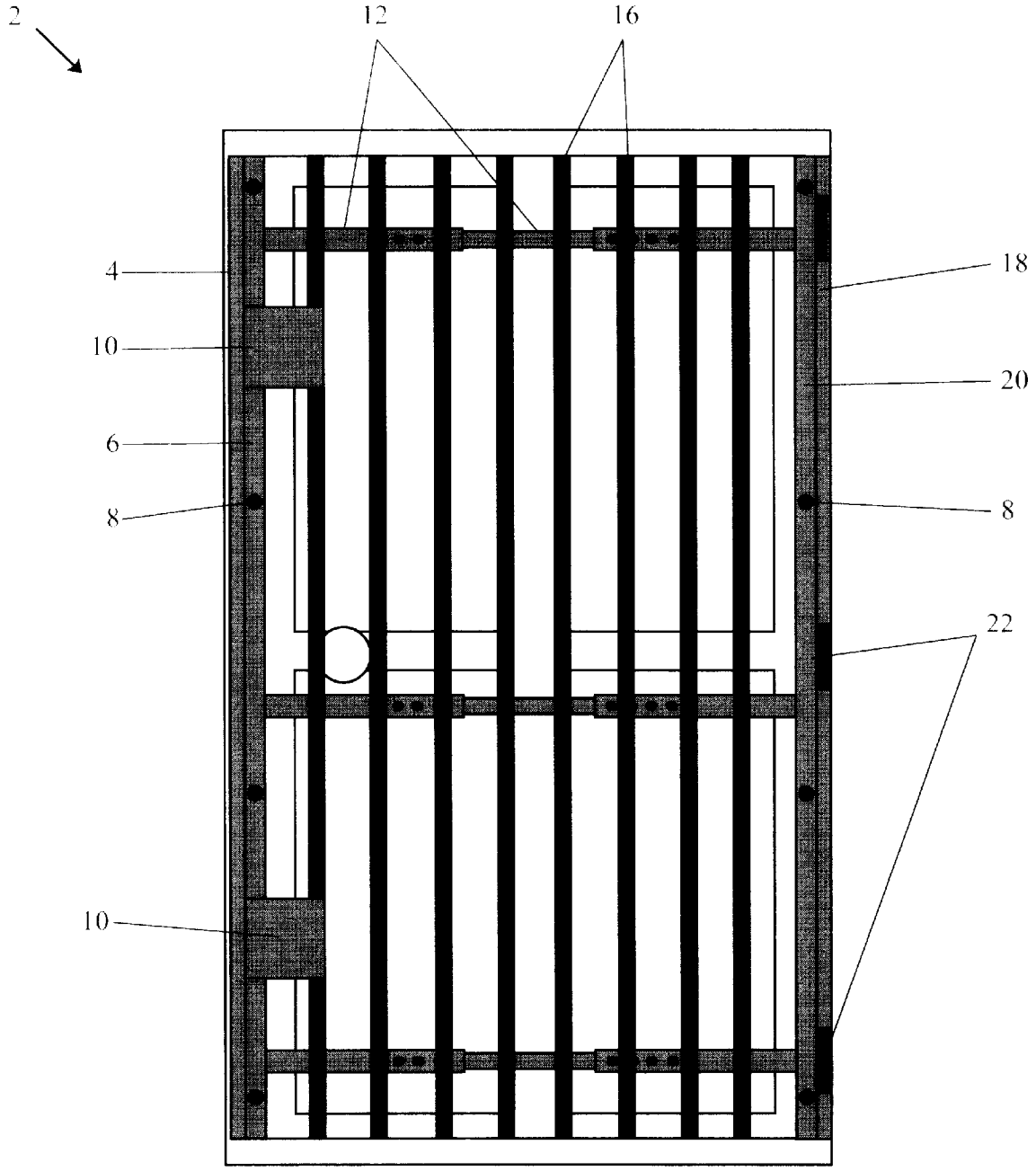
FIG. 1 illustrates a front view of the extensible door guard 2 according to one embodiment of the present invention.

FIG. 1 illustrates a front view of the extensible door guard 2 according to one embodiment of the present invention. Door guard 2 generally comprises a security grill formed from left and right vertical support members 6, 16, respectively, and a plurality of extending lateral support members 12 that extend and support a plurality of vertical bars 16 across a conventional door opening to prevent forced entry therethrough. The door guard 2 also includes left and right angle brackets 4, 18, respectively, for securing the door guard 2 within a conventional door frame. The security grill is pivotally attached by a plurality of hinges 22 to the right angle bracket 18 to provide authorized access to the dwelling.

Figure 2:
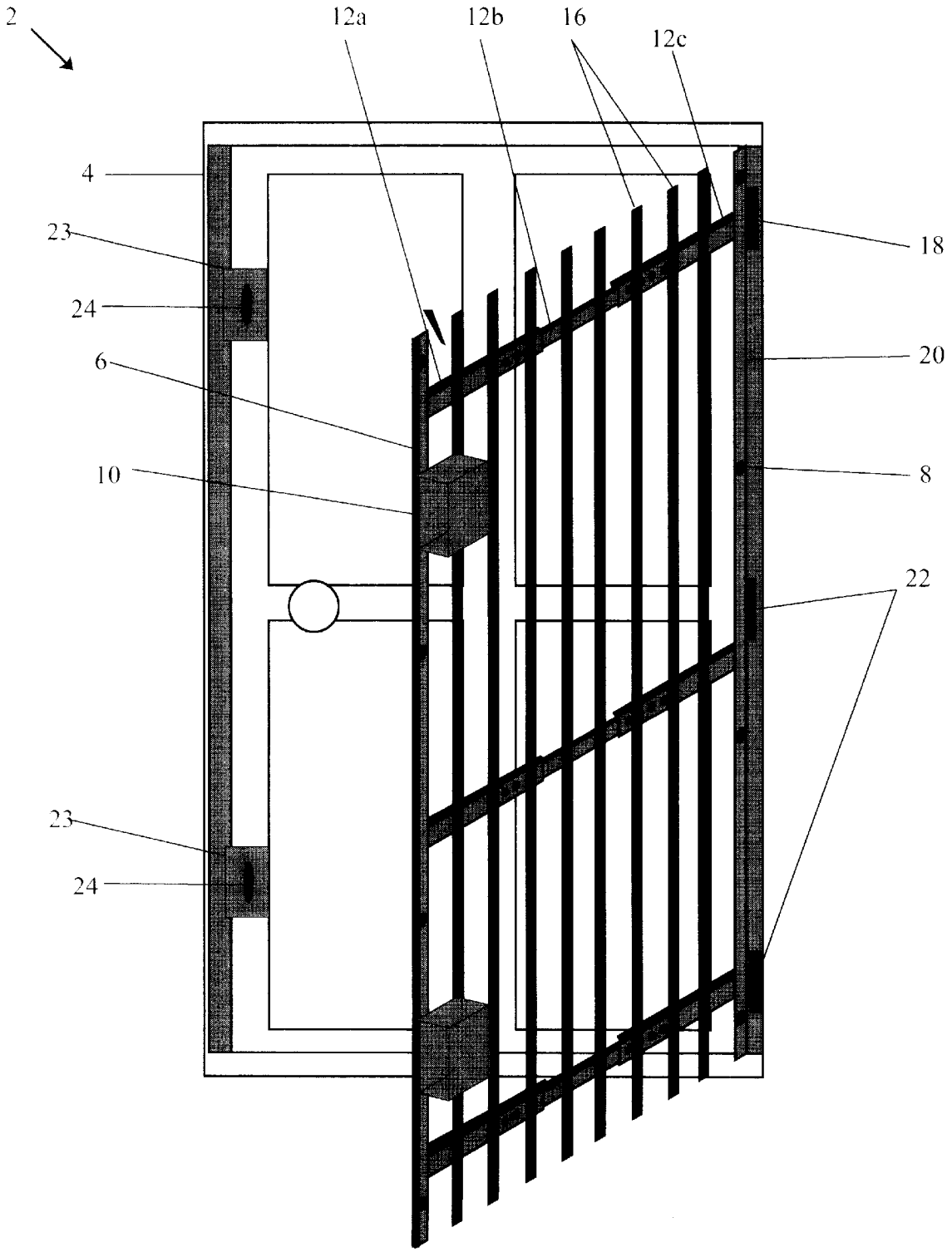
FIG. 2 illustrates a front perspective view of the extensible door guard 2 as it opens outwardly according to the embodiment of FIG. 1.

FIG. 2 illustrates a front perspective view of the extensible door guard 2 as it opens outwardly according to the embodiment of FIG. 1.

On the other hand, the security grill may be locked by one or more enclosed padlocks (to be described) to prevent forcible entry from the outside. For this purpose, a corresponding number of hitch 24 and mounting bracket 23 combinations are welded to the left angle bracket 4. When the security grill is closed, the hitches 23 protrude into padlock enclosures 10 which are welded to the face of the security grill. The padlock enclosures 10 obscure access to the padlocks, thereby maximizing security.

Figure 3:
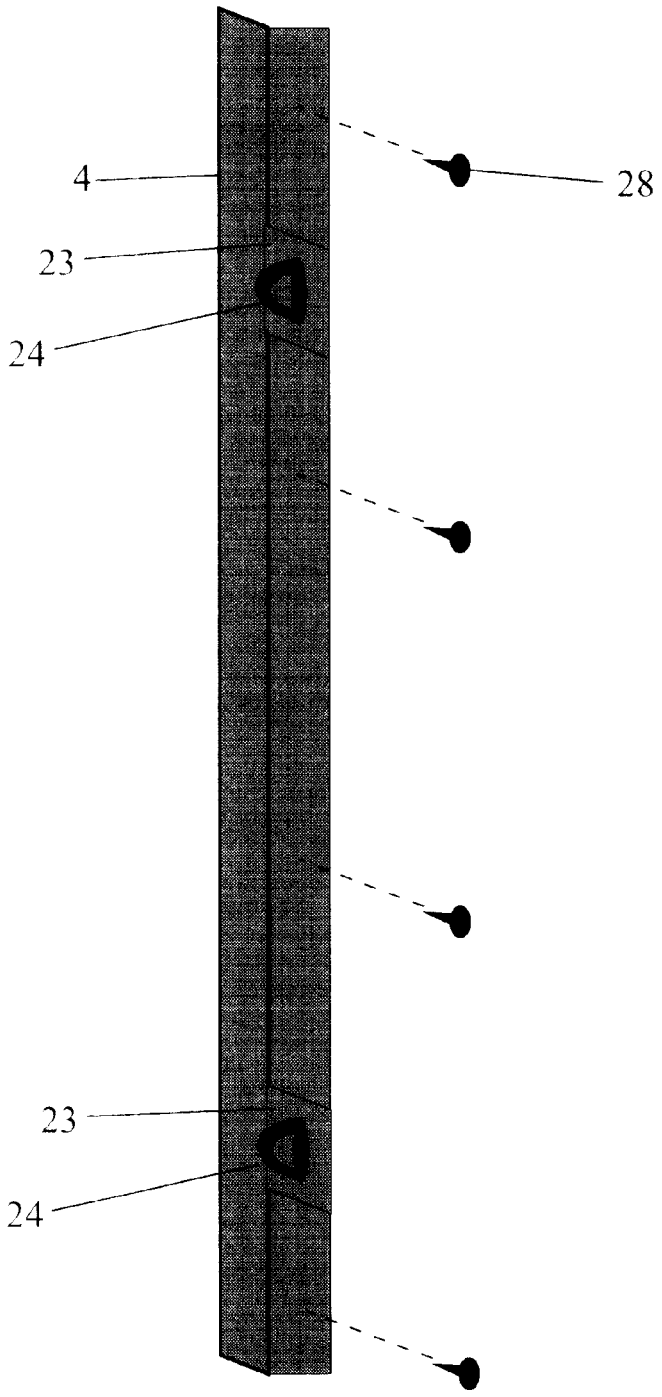
FIG. 3 is a side perspective view of a left angle bracket 4.

FIG. 3 is a side perspective view of a left angle bracket 4. Both the left and right angle brackets 4 are lengths of steel tubing formed with an L-shaped cross-section. Approximately 60 inch lengths are well-suited to fit a wide variety of conventional door openings, and a 2 inch by 2 inch 90 degree angle is sufficient to allow the brackets 4, 18 to be securely anchored to conventional door frames. Both brackets 4, 18 are formed with bore-holes spaced along their lengths at regular intervals, and conventional non-removable (one-way) screws are inserted through the bore-holes for screw-attachment of the brackets 4,18 to opposing sides of the door frame. As described above, the security grill may be locked by one or more enclosed padlocks to prevent forcible entry from the outside, and a corresponding number of hitch 24 and mounting bracket 23 combinations are welded to the left angle bracket 4 for this purpose. Three evenly spaced hitch 24 and mounting bracket 23 combinations serve well. The mounting brackets 23 are simple rectangular steel plates that are welded to protrude inwardly from the bracket 4. Hitch 24 may be a simple U-shaped catch that is welded or screwed to protrude forwardly of the mounting plate 23.

When the security grill is closed, the hitches 23 protrude into padlock enclosures 10 (to be described) which are welded to the face of the security grill.

Figure 4:
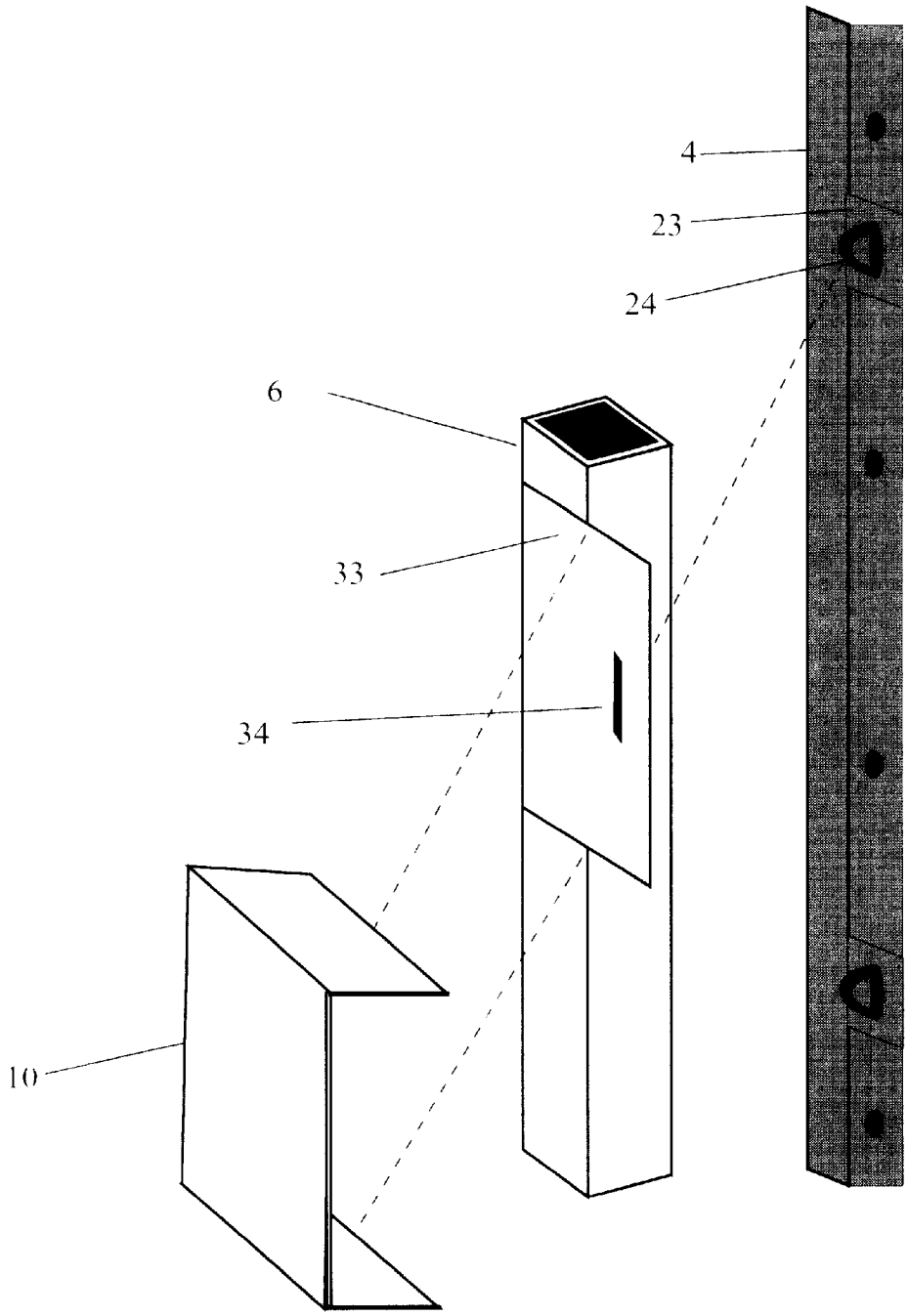
FIG. 4 is an exploded perspective drawing showing the padlock enclosures 10 which are welded to the face of the security grill, and the manner by which hitches 23 protrude therethrough.

FIG. 4 is an exploded perspective drawing showing the padlock enclosures 10 which are welded to the face of the security grill, and the manner by which hitches 23 protrude therethrough. Each padlock enclosure includes a base plate 33 that is welded to the front of the left vertical support member 6.

Both the left and right vertical support members 6, 16, are lengths of steel tubing formed with a rectangular cross-section. Approximately 60 inch lengths are well-suited to fit a wide variety of conventional door openings.

The base plates 33 are rectangular steel plates that arc welded to protrude inwardly from the left vertical support member 6. Each base plate 33 is defined by a central slot to pass a corresponding hitch 24. A conventional padlock (not shown) is then locked around the hitch 24 to lock the security grill in a closed position.

A padlock enclosure 10 is welded over top of the base plate 33 to obscure access to the padlock. Each padlock enclosure 10 is a three-walled steel casing as shown. This particular three-walled configuration eliminates direct frontal access to the padlock, thereby protecting against crowbars or sledge-hammers. On the other hand, authorized key access is still possible from either side.

Figure 5:
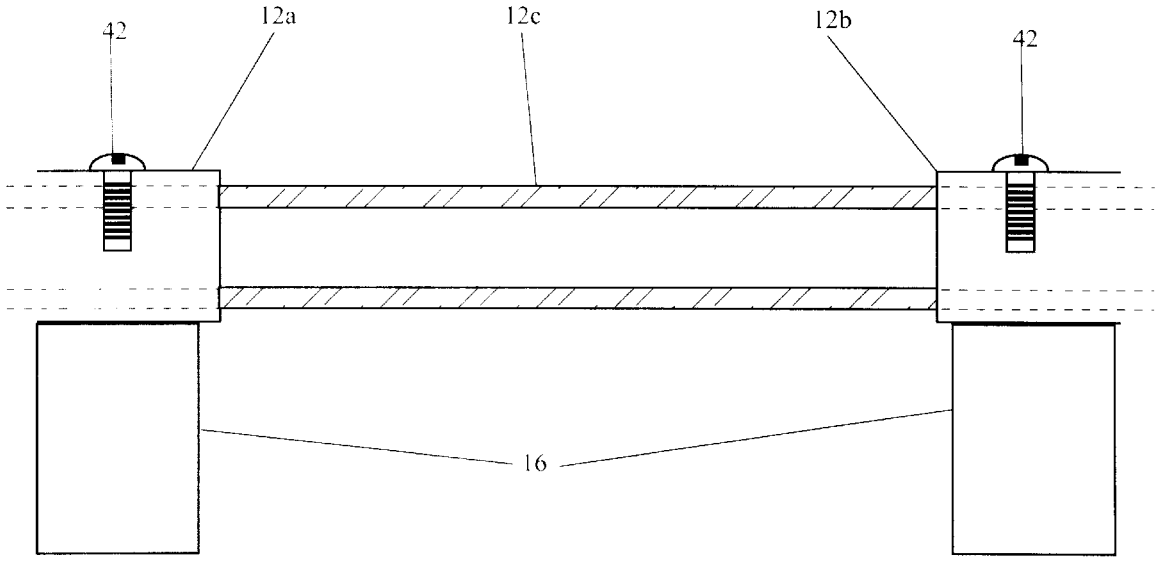
FIG. 5 is a front cross-sectional view of an extending lateral support member 12, a plurality of which span the that vertical support members 6, 16 at regular intervals.

FIG. 5 is a front cross-sectional view of an extending lateral support member 12, a plurality of which span the that vertical support members 6, 16 at regular intervals. Each lateral support member 12 further comprises left and right sleeves 12*a*, 12*b*, and an intermediate extendor 12*c* that fits within sleeves 12*a* and 12*b*. Both left and right sleeves 12*a*, 12*b* are lengths of steel tubing formed with a rectangular cross-section. Approximately 15 inch lengths are well-suited to adjust to a wide variety of conventional door openings. Sleeves 12*a* and 12*b* are welded at one end to vertical support members 6, 18, and they are formed with a series of evenly spaced bore-holes running toward the distal ends. Intermediate extendor 12*c* is likewise a length of steel tubing formed with a rectangular cross-section. Approximately 12 inch lengths are well-suited, and the cross-sectional dimensions are slightly smaller than sleeves 12*a* and 12*b* to allow the intermediate extendor 12*c* to be slidably carried between the sleeves. Intermediate extendor 12*c* is formed with a series of evenly spaced bore-holes running along its entire length. In operation, the opposing sides of the security grill are adjusted by extending sleeves 12*a* and 12*b* along intermediate extendor 12*c*, and by locking the three sections in the desired position by attaching screws through the aligned holes in the three sections 12*a–c*. It is noteworthy that the bore-holes are spaced along the rear of the sections 12*a–c*, and conventional non-removable (oneway) screws are inserted through the bore-holes for screw-attachment . This makes the screws 44 virtually unassailable from the outside, thereby maximizing security.

The door guard 2 also includes left and right angle brackets 4, 18, respectively, for securing the door guard 2 within a conventional door frame. The security grill is pivotally attached by a plurality of hinges 22 to the right angle bracket 18 to provide authorized access to the dwelling. On the other hand, the security grill is lockable by one or more enclosed padlocks (to be described) to prevent forcible entry from the outside. Each padlock is protected within a padlock enclosure 10 that obscures access to the padlock, thereby maximizing security.

Figure 6:
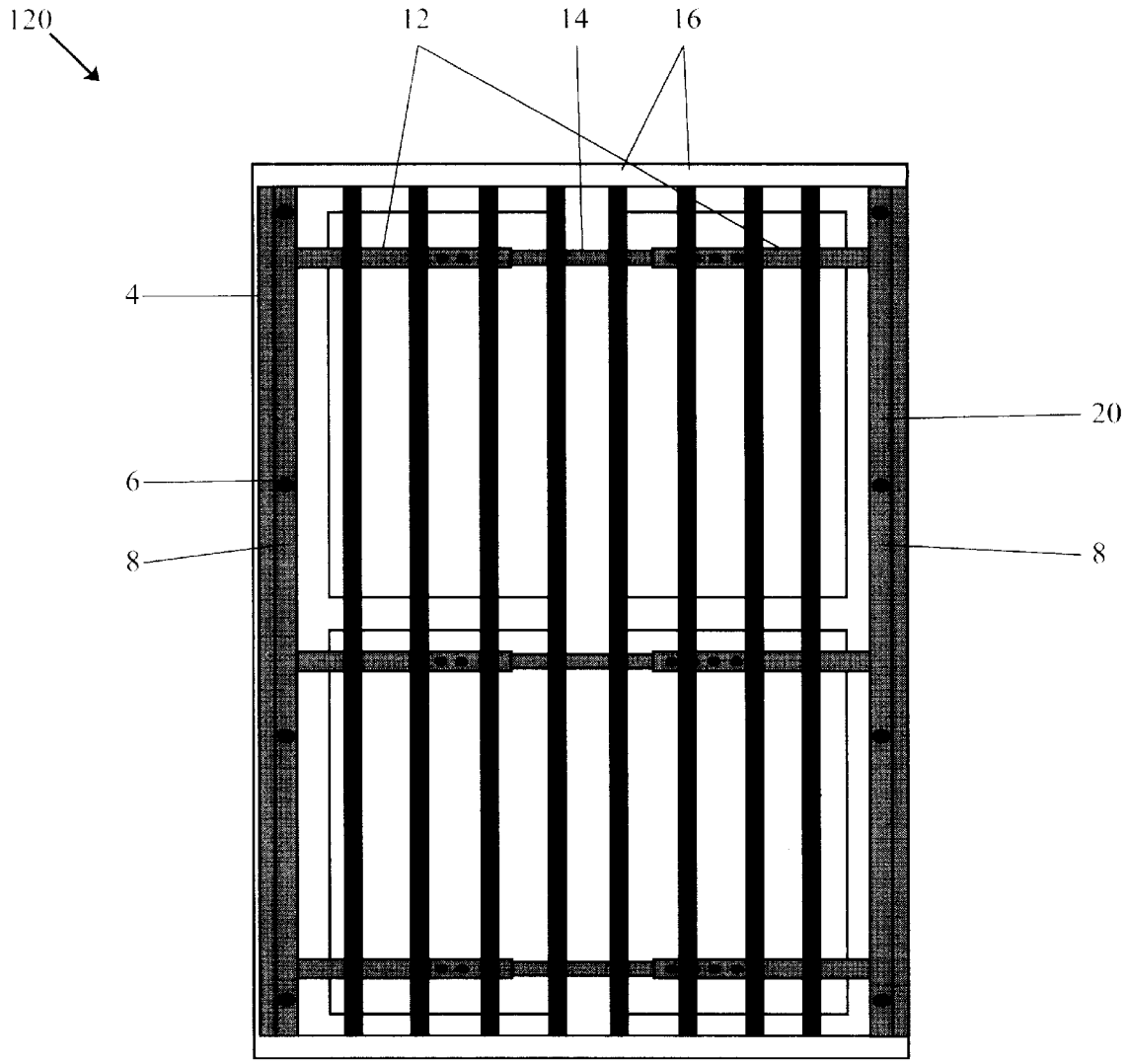
FIG. 6 is a front view of a window guard according to another embodiment of the present invention.

FIG. 6 is a front view of a window guard according to another embodiment of the present invention. As before, window guard 120 comprises a security grill formed from left and right vertical support members 6, 16, respectively, and a plurality of extending lateral support members 12 that extend and support a plurality of vertical bars 16 across a conventional window opening to prevent forced entry therethrough. Of course, the dimensions of the above-referenced components are altered to conform to the smaller dimensions of a window. However, the components are otherwise identical to the embodiment of FIGS. 1–5. The window guard 120 also includes left and right angle brackets 4, 18, respectively, for securing the door guard 120 within a conventional window frame. The security grill is anchored to the right angle bracket 18. The main difference is that this embodiment is not hinged and requires no hinges, hitches or mounting brackets. There are left and right angle brackets 4 formed from lengths of steel tubing with an L-shaped cross-section. Approximately 36 inch lengths are well-suited to fit a wide variety of conventional window openings, and a 2 inch by 2 inch 90 degree angle is sufficient to allow the brackets 4, 18 to be securely anchored to conventional window frames. Both brackets 4, 18 are formed with bore-holes spaced along their lengths at regular intervals, and conventional non-removable (one-way) screws are inserted through the bore-holes for screw-attachment of the brackets 4,18 to opposing sides of the window frame.

The lateral support members 12 are also the same (albeit shorter), and they span the vertical support members 6, 16 at regular intervals. As before, each lateral support member 12 further comprises left and right sleeves 12*a*, 12*b*, and an intermediate extendor 12*c* that fits within sleeves 12*a* and 12*b*. Both left and right sleeves 12*a*, 12*b* are lengths of steel tubing formed with a rectangular cross-section. Approximately 15 inch lengths are well-suited to adjust to a wide variety of conventional window openings. Sleeves 12*a* and 12*b* are welded at one end to vertical support members 6, 18, and they are formed with a series of evenly spaced bore-holes running toward the distal ends. Intermediate extendor 12*c* is likewise a length of steel tubing formed with a rectangular cross-section. Approximately 12 inch lengths are well-suited, and the cross-sectional dimensions are slightly smaller than sleeves 12*a* and 12*b* to allow the intermediate extendor 12*c* to be slidably carried between the sleeves. Intermediate extendor 12*c* is formed with a series of evenly spaced bore-holes running along its entire length. In operation, the opposing sides of the security grill are adjusted by extending sleeves 12*a* and 12*b* along intermediate extendor 12*c*, and by locking the three sections in the desired position by attaching screws through the aligned holes in the three sections 12*a–c*. It is noteworthy that the bore-holes are spaced along the rear of the sections 12*a–c*, and conventional non-removable (one-way) screws are inserted through the bore-holes for screw-attachment . This makes the screws 44 virtually unassailable from the outside, again maximizing security.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. A security apparatus, comprising:

a security grill having an extending left section and right section, said left section further comprising a left vertical support member, a plurality of tubular lateral support members extending rightwardly therefrom, and a plurality of vertical bars attached to and supported by said lateral support members, and said right section further comprising a right vertical support member, a plurality of tubular lateral support members extending leftwardly therefrom, and a plurality of vertical bars attached to and supported by said lateral support members;

a plurality of intermediate extension members each inserted into a corresponding pair of said left and right tubular lateral support members and slidable therein to allow extension of said left security grill section with respect to said right section;

wherein each said intermediate extension member is provided with a plurality of holes on a rear surface of each of said intermediate extension members, and each said tubular lateral support member is provided with a plurality of hoes on a rear surface of each said tubular lateral support members, said holes on said intermediate extension members being in alignment with said holes in said tubular lateral support members for receiving a locking member through said aligned holes to lock the security apparatus at a desired width;

a plurality of vertical bars rigidly affixed to and supported by said plurality of intermediate extension members;

a left angle bracket for securing one side of said security grill to one of a door and a window frame;

a right angle bracket for securing another side of said security grill to an opposing side of one of said door and window frame;

whereby said security apparatus may be attached exteriorly to one of a door and a window frame to prevent forcible entry.

2. The security apparatus according to claim 1, wherein said right grill section is attached to said right angle bracket by a plurality of hinges to allow outward pivoting of said right grill section to provide authorized access to a dwelling.

3. The security apparatus according to claim 2, wherein a number of hitch and mounting bracket combinations are welded to the left angle bracket, and said left grill section further comprises a corresponding number of padlock enclosures welded to a face thereof, wherein when the security grill is closed, said hitches protrude into padlock enclosures to allow locking with a conventional padlock, and said padlock enclosure obscures access to the padlock, thereby maximizing security.

4. The security apparatus according to claim 2, wherein a number of hitch and mounting bracket combinations are welded to the left angle bracket, and said left grill section further comprises a corresponding number of padlock enclosures welded to a face thereof, wherein when the security grill is closed, said hitches protrude into padlock enclosures to allow locking with a conventional padlock and said padlock enclosure obscures access to the padlock, thereby maximizing security.

* * * * *